US005327850A

United States Patent [19]

Sly et al.

[11] Patent Number: 5,327,850

[45] Date of Patent: Jul. 12, 1994

[54] ROADWAY MARKER

[75] Inventors: Michael W. Sly, Kent; Peter A. Speer, Kirkland; Harry J. Glutting, Tacoma, all of Wash.

[73] Assignee: Davidson Plastics Company, Kent, Wash.

[21] Appl. No.: 735,321

[22] Filed: Jul. 24, 1991

Related U.S. Application Data

[63] Continuation-in-part of Ser. No. 694,873, May 2, 1991, abandoned.

[51] Int. Cl.[5] ..... E01F 9/04

[52] U.S. Cl. ..... 116/63 P; 404/16

[58] Field of Search ..... 116/63 R, 63 P; 404/12, 404/14, 15, 16; D10/113

[56] References Cited

U.S. PATENT DOCUMENTS

| | | | |
|---|---|---|---|
| D. 207,038 | 2/1967 | Haley | D72/1 |
| D. 220,553 | 4/1971 | Hedgewick | D10/113 |
| D. 266,060 | 9/1982 | Beretta | D10/113 |
| D. 266,554 | 10/1982 | Beretta | D10/113 |
| D. 267,933 | 2/1983 | Luckinbill | D10/113 |
| D. 289,267 | 4/1987 | Garner | D10/113 |
| D. 311,704 | 10/1990 | May | D10/113 |
| 2,208,080 | 7/1940 | Overdorff | 404/15 X |
| 2,666,373 | 1/1954 | Mattson | 404/16 |
| 2,991,698 | 7/1961 | Leubaz | 404/16 |
| 3,179,009 | 4/1965 | Sheffield et al. | 88/79 |
| 3,478,714 | 11/1969 | Keats | 116/63 P |
| 3,485,148 | 12/1969 | Heenan | 404/12 |
| 3,758,191 | 9/1973 | Hedgewick | 404/16 X |
| 4,208,090 | 6/1980 | Heenan | 350/61 |
| 4,232,979 | 11/1980 | Johnson, Jr. et al. | 404/16 |
| 4,428,320 | 1/1984 | Oplt et al. | 116/63 |
| 4,462,711 | 7/1984 | Garner | 404/10 |
| 4,626,127 | 12/1986 | May | 404/14 |
| 4,653,955 | 3/1987 | Racs | 404/14 |
| 4,726,706 | 2/1988 | Attar | 116/63 R X |
| 4,813,811 | 3/1989 | Adams | 404/15 |
| 4,818,138 | 4/1989 | Brown | 404/14 |
| 4,875,798 | 10/1989 | May | 404/14 X |

FOREIGN PATENT DOCUMENTS

| | | | |
|---|---|---|---|
| 2596081 | 9/1987 | France | 404/16 |
| 2104946 | 3/1983 | United Kingdom | 404/16 |
| 2140850 | 12/1984 | United Kingdom | 404/15 |
| 2175335 | 11/1986 | United Kingdom | 404/16 |

*Primary Examiner*—William A. Cuchlinski, Jr.
*Assistant Examiner*—John L. Beres
*Attorney, Agent, or Firm*—Christensen, O'Connor, Johnson & Kindness

[57] ABSTRACT

An extrudable roadway marker (11) is provided having enhanced stability. The roadway marker has a constant cross section along a centerline (A—A) that allows the roadway marker to be manufactured by extrusion. The base (13) of the roadway marker has a series of adjacent parallel grooves (27) that provide a large adhesive surface. Downwardly extending gripping edges (19) assist in attaching the roadway marker to a roadway surface. In one form, the sides of the roadway marker have reflective tape recesses (17) for receiving and protecting reflective strips 23. A raised rumble portion (15) provides a physical rumbling cue. A recess (25) reduces the weight of the roadway marker. The ends of the marker can be sheared flat or inclined. The parallel grooves may form sharp teeth where they join. The sharp teeth project away from the center of the roadway marker.

25 Claims, 6 Drawing Sheets

ROADWAY MARKER

CROSS-REFERENCE TO RELATED APPLICATION

This application is a continuation-in-part of U.S. patent application Ser. No. 07/694,873 filed May 2, 1991, now abandoned, and entitled Roadway Marker.

TECHNICAL AREA OF THE INVENTION

This invention relates to roadway markers and, more particularly, to an extrudable lightweight roadway marker having enhanced stability.

BACKGROUND OF THE INVENTION

Roadway markers are utilized in a variety of traffic control applications. Many roadway markers are permanently affixed to a roadway to delineate lanes of traffic on the roadway. Other roadway markers are used to temporarily delineate construction or work areas. Roadway markers used in such applications are called temporary roadway markers. Both permanent and temporary roadway markers are attached to a roadway with a suitable adhesive.

Permanent roadway markers remain in place and define traffic lanes, identify obstacles and perform other well known functions. Many permanent roadway markers are raised to create a rumble in an automobile when the tires of the automobile impact a row of markers. The most commonly used permanent roadway marker is formed of ceramic and has a semi-hemispherical or button shape.

Temporary roadway markers serve to notify motorists that a construction area is near and that caution is needed. They often direct roadway traffic to pass along the portions of the roadway unaffected by construction, while protecting workers within a construction area from roadway traffic. After construction is completed, temporary roadway markers are loosened and removed. To be effective temporary roadway markers must alert traffic of the construction area. Typically, temporary roadway markers warn oncoming motorists by (1) the use of visual cues such as reflective surfaces, or (2) the use of physical cues such as causing a vehicle to rumble on contact with the marker. Both permanent and temporary roadway markers that provide visual cues often have a reflective surface that reflects light back to a driver. As noted above, physical cues are provided by a raised portion that causes the automobile to rumble upon contact with the marker. One example of a roadway marker that provides both visual and physical cues is described in U.S. Pat. No. 4,428,320, issued to Oplt et al. and entitled "Reflective Paving Marker." The Oplt et al. patent describes a roadway marker having a generally trapezoidal prism shape with a honeycombed interior, a reflective surface and raised areas. The honeycombed interior makes the marker lightweight, which is desirable. Although the roadway marker is lightweight, one disadvantage of the Oplt et al. roadway marker is its high manufacturing cost. Due to its construction, the Oplt et al. roadway marker must be injection molded. Injection molding is expensive when compared to other manufacturing processes such as extrusion. Many prior art roadway markers share these same disadvantages because they can only be formed by injection or some other molding processes.

The present invention provides lightweight, low-cost roadway markers that provide a physical rumbling cue and, in some versions, a visual (reflective) cue. Roadway markers formed in accordance with the present invention have a constant cross-sectional shape throughout their length, which allows them to be made by inexpensive extrusion manufacturing processes.

SUMMARY OF THE INVENTION

In accordance with this invention, an extruded roadway marker is provided. The marker has a constant cross-sectional shape, which includes a base area suitable for adhesive connection to a roadway surface, and a raise rumble portion. The base area of the marker has a plurality of adjacent parallel grooves of arcuate cross section. Two parallel edges of the base curve downwardly for gripping the roadway. The top of the raised rumble portion is scalloped to reduce the weight of the roadway marker.

In accordance with other aspects of this invention, two lateral sides of the raised rumble portion of the roadway marker each include a recess for receiving a strip of reflective tape. The other two sides may be sheared straight or inclined, depending upon the intended use of the marker.

In accordance with further aspects of this invention, the teeth formed by the adjacent parallel grooves are sharp and project away from the longitudinal center of the roadway marker.

In accordance with alternative aspects of this invention, rather than the lateral sides including recesses for receiving a strip of reflective tape, the lateral sides are inclined toward the scalloped top. If desired, the ridges where the lateral sides and the scallop meet can be beveled to reduce the abruptness of the change therebetween.

BRIEF DESCRIPTION OF THE DRAWINGS

The foregoing and other advantages and features of this invention will become better understood by reference to the following description of a preferred embodiment of the invention when taken in conjunction with the accompanying drawings wherein.

DESCRIPTION OF THE PREFERRED EMBODIMENT

Figure 1:
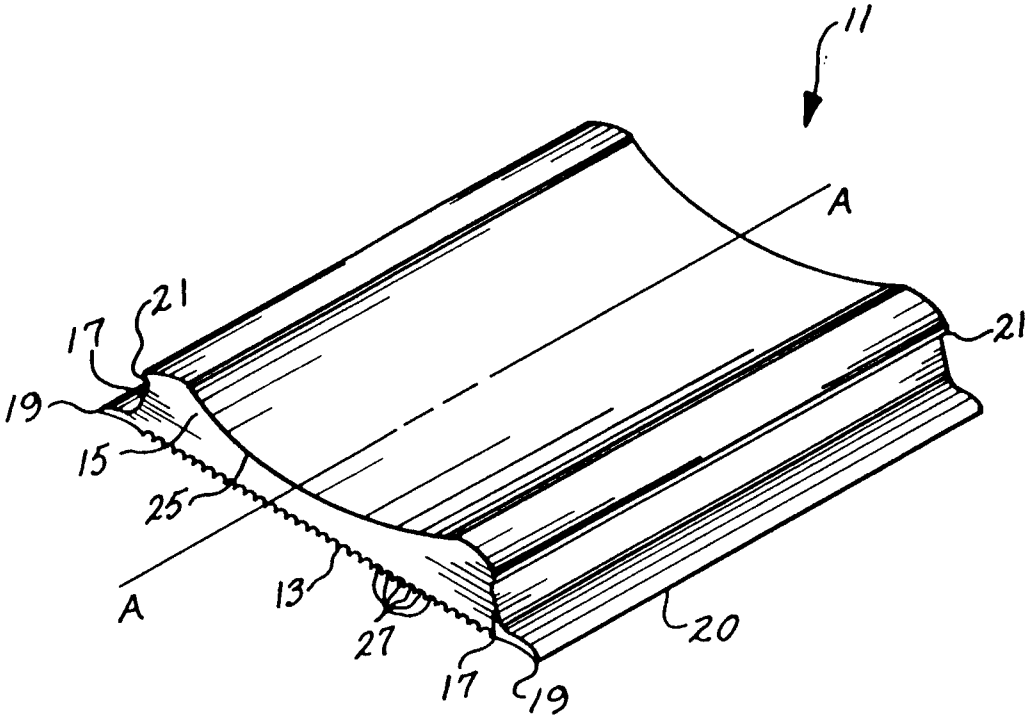
FIG. 1 is an isometric view of a roadway marker formed in accordance with the present invention.

As shown in FIG. 1, a roadway marker 11 formed in accordance with this invention is one integral piece having a constant cross section from one end of the other along a longitudinal centerline A—A. The constant cross section allows the marker to be extruded and sheared to the desired length. The roadway marker 11 illustrated in FIG. 1 has a base area 13 and a raised rumble portion 15. The base area 13 is substantially planar and of rectangular shape. The large base area allows the roadway marker to be strongly attached to a roadway surface by any suitable adhesive, such as epoxy butyl or hot melt. Two parallel gripping edges 19 located at the ends of wings 20, that protrude outwardly from the rumble portion 15, partially define the rectangular base area 13. The edges 19 are parallel to the longitudinal centerline A—A. Both edges 19 curve downwardly along their entire length, away from the substantially planar base area 13. The downward curvature allows for enhanced gripping of a roadway surface. More specifically, when an automobile tire impacts the roadway marker 11 generally orthogonally to the longitudinal centerline A—A, the tire force tends to cause the edges 19 to dig into the roadway surface. Thus, the two gripping edges 19 facilitate the stability of the roadway marker 11.

Figure 3:
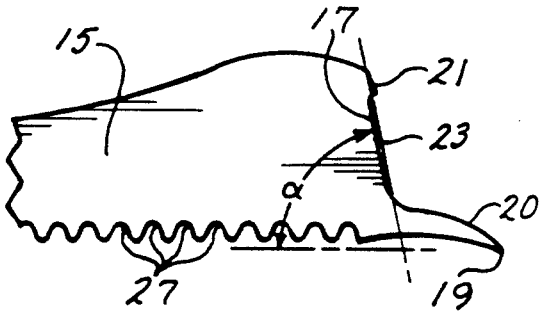
FIG. 3 is an enlarged end view of one side of the roadway marker of FIG. 1.

As shown best in FIG. 3, the base area 13 includes a series of parallel grooves 27. The grooves are disposed adjacent and parallel one another. The grooves 27 are also parallel to the longitudinal centerline A—A. The grooves 27 extend the entire length of the marker 11 and have an arcuate cross section. The arcuate cross section increases the adhesion area of the base 13. The larger adhesion area allows the base to be better attached to a roadway. Arcuate grooves provide a larger surface area for adhesive than do the V-shaped grooves of some prior art roadway markers. This translates into better roadway surface attachment.

Figure 4:
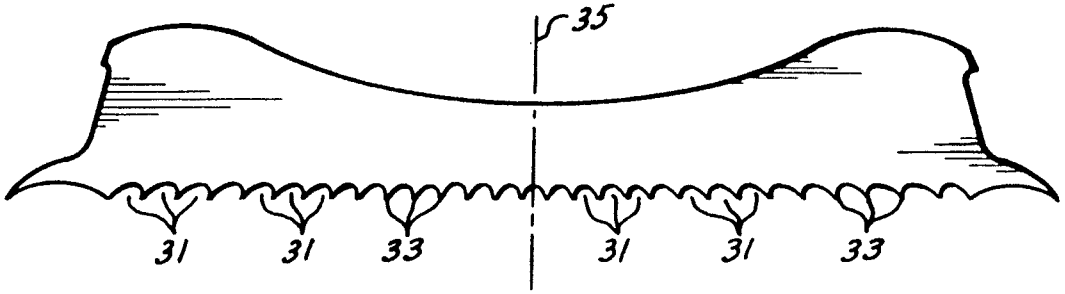
FIG. 4 is an end view of an alternative embodiment of the invention.

FIG. 4 illustrates an alternate base configuration. Like the base configuration shown in FIG. 3, the base configuration shown in FIG. 4 includes a plurality of parallel grooves 31, each having an arcuate cross section. However, rather than the teeth created where the grooves meet being rounded, as shown in FIG. 3, the teeth 33 of the FIG. 4 base configuration are pointed, making them sharp. Further, the pointed teeth project away from the center 35 of the base. The sharp teeth 33 and their projection direction greatly improve the roadway holding power of the roadway marker 11. More specifically, the action of traffic causes the roadway marker to pull away from the adhesive that attaches the marker to a roadway. As the roadway marker is pulled away, the adhesive tries to elongate. The pointed teeth lock the adhesive into the base to improve adhesive performance.

Figure 2:
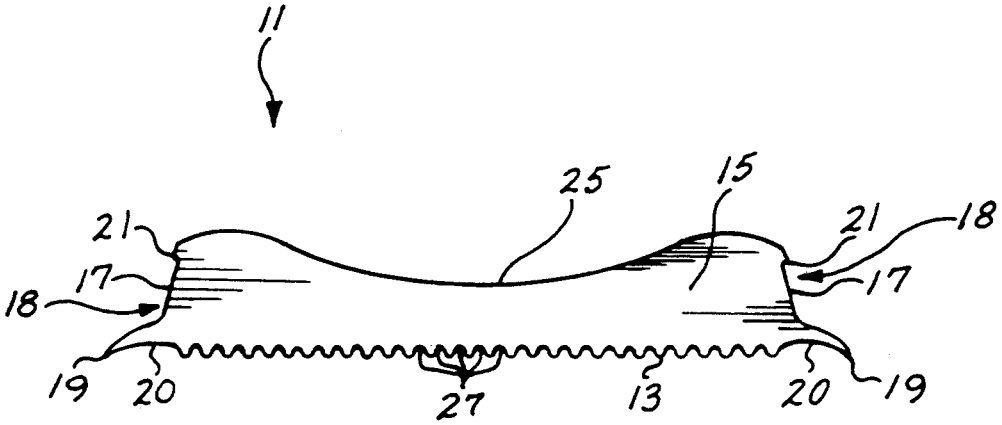
FIG. 2 is an end view of the roadway marker of FIG. 1.

Referring to FIG. 2, the raised rumble portion 15 extends upwardly from the base area 13. The raised rumble portion 15 extends the entire length of the roadway marker 11 as measured along the centerline A—A. The raised rumble portion 15 has a cross-sectional shape taken in a plane lying orthogonal to the centerline A—A that is substantially an isosceles trapezoid with a scalloped recess 25 in the top surface of the trapezoid. This cross-sectional shape is constant throughout the entire length of the roadway marker 11. The raised rumble portion includes parallel lateral sides 17 that run the length of the marker. The lateral sides 17 are defined by the substantially vertical sides of the trapezoidal shape of the raised rumble portion. The lateral sides 17 are offset from the gripping edges 19 by the width of the wings 20. Thus, the width of the raised rumble portion 15 is less than the width of the base area 13. The ends of the extruded shape are, of course, sheared flat.

The scalloped recess 25 of the raised rumble portion 15 has a continuous arcuate shape that is symmetrical about the centerline A—A of the roadway marker 11. The primary function of the scalloped recess 25 is to reduce the weight of the roadway marker. Thus it will be appreciated that the exact shape of the recess is not critical. One important aspect of the recess 25 is its average radius of curvature. In this regard, although the exact specifications of the curvature are not crucial, the average radius of curvature of the recess should be substantially less than the radius of curvature of a typical automobile tire. This prevents an automobile tire from seating into the recess 25 when the tire passes over the roadway marker 11. In one embodiment of the invention, the radius of curvature of the recess area is about four inches. The preferred range is two inches to ten inches.

Referring to FIG. 3, the lateral sides 17 of the raised rumble portion 15 partially form a reflective tape recesses 18. The reflective tape recesses 18 are completed by overhanging lips 21. The overhanging lips 21 extend outwardly from the top of the raised rumble portion 15. The reflective tape recesses 18 receive reflective tape or a reflective strip 23 (not shown in FIGS. 1 and 2) that provides a visual cue to roadway traffic. The recesses 18 provide protection for the reflective tape or strip 23 from abrasive contact with an automobile tire. In one preferred embodiment, the recesses 18, and thus the lateral sides 17, are inclined from the base 13 by an angle $\alpha$ of about 75° to 80°. It has been found that this angle of inclination is well suited to reflecting incident light from automobile headlights back to a driver. The gripping edges 19 provide protection for the reflective strips 23 from any adhesive that might ooze out. If adhesive comes in contact with the adhesive strips, the night reflective properties of the strips can be greatly reduced. In this regard, it should be noted that the reflective strips provide motorists guidance during the day as well as at night. More specifically, when the raised rumble portion 15 is installed perpendicular to the direction of traffic, the reflective strips provide visual cues during daytime as well as nighttime hours.

FIGS. 5–10 illustrate alternate embodiments of roadway markers formed in accordance with this invention. In most instances, for ease of understanding, the same elements of the embodiments of the inventions illustrated in FIGS. 5–10 are identified by the same reference numbers and letters used in FIGS. 1–3.

Figure 5:
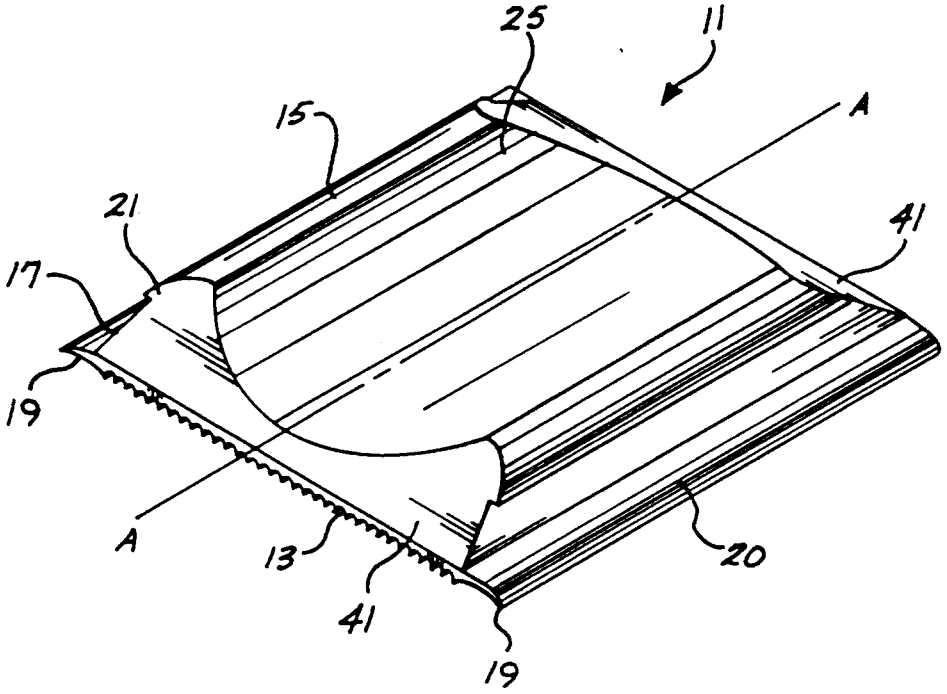
FIG. 5 is an isometric view of a roadway marker of the type illustrated in FIG. 1 with inclined, rather than vertical, ends.
Figure 6:
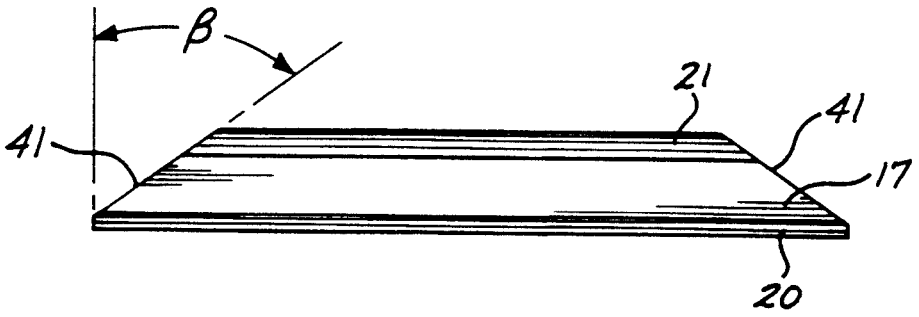
FIG. 6 is a side view of the roadway marker illustrated in FIG. 5.

The embodiment illustrated in FIGS. 5 and 6 is substantially identical to the embodiments illustrated in FIGS. 1–3, the exception being that the ends 41 of the raised rumble portion 15 are inclined rather than orthogonal to the plane of the base 13 of the roadway marker. While various angles can be used, the presently preferred angle range, with respect to the vertical, angle $\beta$ in FIG. 6, is 40° to 70°, with 60° being preferred. The angled ends 41 make the roadway marker better suited for permanent roadway marker installations because automobile tires hitting the ends of the marker are less likely to dislodge the marker.

Figure 7:
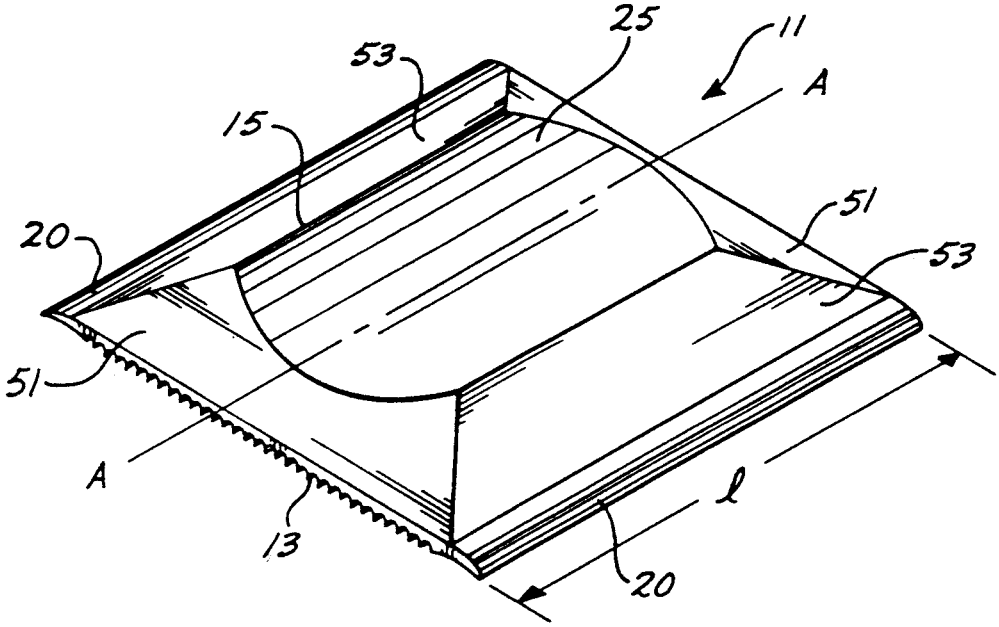
FIG. 7 is an isometric view of an alternative embodiment of the invention.
Figure 8:
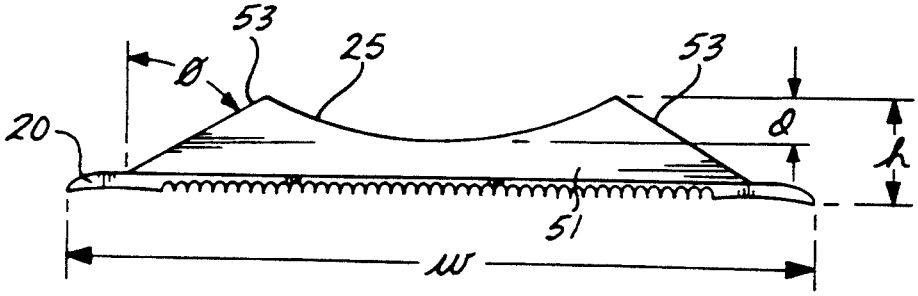
FIG. 8 is an end view of the embodiment of the invention illustrated in FIG. 7.

While the ends 51 of the roadway marker illustrated in FIGS. 7 and 8 are, like the embodiment of FIGS. 5 and 6, inclined, the lateral sides 53 of the rumble portion 15 is shaped differently. More specifically, rather than including a recess, the lateral sides 53 incline upwardly from the wings 20 to create a truncated pyramid shape having a scalloped recess 25. While various inclination angles can be used, as shown in FIG. 8, the presently preferred angle $\phi$, with respect to the vertical is 60°. Further, the preferred range of the radius of curvature of the scalloped recess is 2.5–3.0 inches. In one actual embodiment of the invention, the overall height (h) is 0.5 inches, the base width (w) and length (l) are 4.0 inches and the scallop depth (d) is 0.25 inches.

Figure 9:
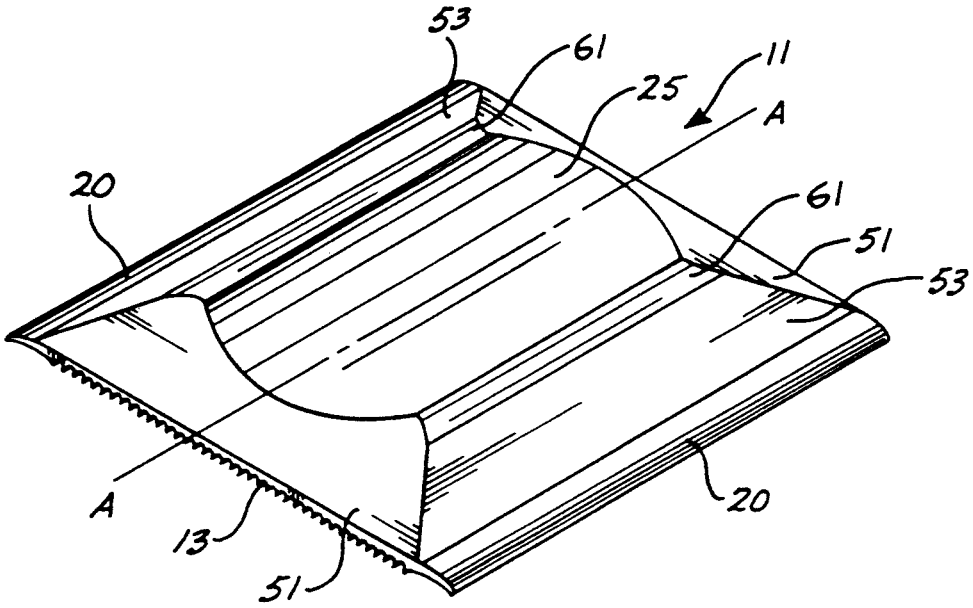
FIG. 9 is an isometric view of another alternative embodiment of the invention.
Figure 10:
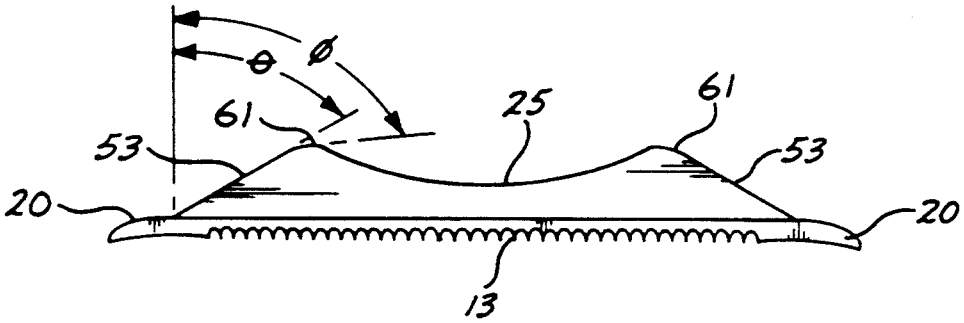
FIG. 10 is an end view of the embodiment of the invention illustrated in FIG. 9.

The embodiment of the invention illustrated in FIGS. 9 and 10 is identical to the embodiment illustrated in FIGS. 7 and 8 except that the ridges 61 where the scalloped recess 25 meets the inclined lateral sides 53 are beveled. The preferred beveled angle, $\theta$, is 80° with respect to the vertical.

Because a roadway marker 11 formed in accordance with this invention has a constant cross section, embodiments of the present invention can be manufactured by extrusion. That is, embodiments of the invention can be formed by extruding a suitable plastic (or metal) through a die having a shape corresponding to the desired cross section configuration. The extrudate is then cured and hardened. The manufacture of roadway markers using an extrusion method greatly decreases the cost of such markers. Moreover, an extension method allows the roadway markers of the present invention to be easily manufactured in varying lengths as well as with inclined or orthogonal end cuts. This allows embodiments of the invention to be used as "rumble" strips as well as spaced-apart roadway markers. The continuous nature of the base allows less adhesive to be used to create a strong bond when compared to bases that are interrupted by hollow regions, such as that described in the Oplt et al. patent referenced above. Adhesive tends to ooze into the hollows of Oplt et al. bases, reducing adhesive effectiveness.

While preferred embodiments of the invention have been illustrated and described, it will be appreciated that, within the scope of the appended claims, various changes can be made therein without departing from the spirit and scope of the invention. Thus, it is to be understood that within the scope of the appended claims the invention can be practiced otherwise than as specifically described herein.

The embodiments of the invention in which an exclusive property or privilege is claimed are defined as follows:

1. An extruded nonmetallic roadway marker having a planar base area for attachment to a roadway surface and a raised rumble portion, said base area having a plurality of parallel adjacent grooves, said grooves lying parallel to a centerline, said grooves: (i) having an arcuate cross section, (ii) joining one another and (iii) defining sharp teeth, said base area of substantially rectangular shape, said rectangular shape defined in part by two wings located on either side of and lying parallel to said centerline, said wings terminating in gripping edges lying parallel to said centerline, said gripping edges curving downwardly from said base area, said raised rumble portion lying inside of said wings and extending upwardly from said base area, the width of each of said wings being substantially less than the width of said raised rumble portion, said raised rumble portion having two parallel lateral sides and a top area, said raised rumble portion having a constant cross section along a substantial portion of the entire length of said centerline.

2. The roadway marker of claim 1, wherein said raised rumble portion includes two overhanging lips, said overhanging lips extending laterally from the top of said lateral sides of said raised rumble portion, said overhanging lips and lateral sides forming recesses for receiving a reflective strip.

3. The roadway marker of claim 1, wherein said top area of said raised rumble portion is scalloped to form a recess.

4. The roadway marker of claim 1, wherein said lateral sides of said raised rumble portion are inclined to said base area at an angle lying between 75° and 80°.

5. The roadway marker of claim 4, wherein said raised rumble portion includes two overhanging lips, said overhanging lips extending laterally from the top of said lateral sides of said raised rumble portion, said overhanging lips and lateral sides forming recesses for receiving a reflective strip.

6. The roadway marker of claim 5, wherein said top area of said raised rumble portion is scalloped to form a recess.

7. An extruded nonmetallic roadway marker having a planar base area for attachment to a roadway surface and a raised rumble portion, said base area having a plurality of parallel adjacent grooves, said grooves lying parallel to a centerline, said base area of substantially rectangular shape, said rectangular shape defined in part by two wings located on either side of and lying parallel to said centerline, said wings terminating in gripping edges lying parallel to said centerline, said gripping edges curving downwardly from said base area, said raised rumble portion lying inside of said wings and extending upwardly from said base area, the width of each of said wings being substantially less than the width of said raised rumble portion, said raised rumble portion having two parallel lateral sides and a top area, said raised rumble portion having a constant cross section along a substantial portion of the entire length of said centerline, said top area of said raised rumble portion scalloped to form a recess, said recess having a radius of curvature between two inches and ten inches.

8. The roadway marker of claim 7, wherein said raised rumble portion includes two overhanging lips, said overhanging lips extending laterally from the top of said lateral sides of said raised rumble portion, said overhanging lips and lateral sides forming recesses for receiving a reflective strip.

9. An extruded nonmetallic roadway marker having a planar base for attachment to a roadway surface and a raised rumble portion, said base area having a plurality of parallel adjacent grooves, said grooves lying parallel to a centerline, said base area of substantially rectangular shape, said rectangular shape defined in part by two wings located on either side of and lying parallel to said centerline, said wings terminating in gripping edges lying parallel to said centerline, said gripping edges curving downwardly from said base area, said raised rumble portion lying inside of said wings and extending upwardly from said base area, the width of each of said wings being substantially less than the width of said raised rumble portion, said raised rumble portion having two parallel lateral sides and a top area, said raised rumble portion having a constant cross section along a substantial portion of the entire length of said centerline, said lateral sides of said raised rumble portion inclined to said base area at an angle lying between 75° and 80°, said raised rumble portion including two overhanging lips, said overhanging lips extending laterally from the top of said lateral sides of said raised rumble portion, said overhanging lips and lateral sides forming recesses for receiving a reflective strip, said top area of said raised rumble portion scalloped to form a recess, said recess having a radius of curvature between two inches and ten inches.

10. An extruded nonmetallic roadway marker having a planar base area for attachment to a roadway surface and a raised rumble portion, said base area having a plurality of parallel adjacent grooves, said grooves lying parallel to a centerline, said base area of substantially rectangular shape, said rectangular shape defined in part by two wings located on either side of and lying parallel to said centerline, said wings terminating in gripping edges lying parallel to said centerline, said gripping edges curving downwardly from said base area, said raised rumble portion lying inside of said wings and extending upwardly from said base area, the width of each of said wings being substantially less than the width of said raised rumble portion, said raised rumble portion having two parallel lateral sides and a top area, said raised rumble portion having a constant cross section along a substantial portion of the entire length of said centerline, the ends of said roadway marker lying orthogonal to said centerline inclined upwardly and toward one another.

11. The roadway marker of claim 10, wherein said raised rumble portion includes two overhanging lips, said overhanging lips extending laterally from the top of said lateral sides of said raised rumble portion, said overhanging lips and lateral sides forming recesses for receiving a reflective strip.

12. The roadway marker of claim 10, wherein said top area of said raised rumble portion is scalloped to form a recess.

13. The roadway marker of claim 12, wherein said lateral sides of said raised rumble portion are inclined upwardly and toward one another by an angle lying in the range of from 40° to 70°.

14. The roadway marker of claim 13 wherein said ends are inclined to the vertical by an angle lying in the range of from 40° to 70°.

15. The roadway marker of claim 14 wherein the ridge defined by the recess and said lateral sides is beveled.

16. The roadway marker of claim 13 wherein the ridge defined by the recess and said lateral sides is beveled.

17. The roadway marker of claim 12, wherein said recess has a radius of curvature between two inches and ten inches.

18. The roadway marker of claim 17, wherein said raised rumble portion includes two overhanging lips, said overhanging lips extending laterally from the top of said lateral sides of said raised rumble portion, said overhanging lips and lateral sides forming recesses for receiving a reflective strip.

19. The roadway marker of claim 10, wherein said lateral sides of said raised rumble portion are inclined to said base area at an angle lying between 75° and 80°.

20. The roadway marker of claim 19, wherein said raised rumble portion includes two overhanging lips, said overhanging lips extending laterally from the top of said lateral sides of said raised rumble portion, said overhanging lips and lateral sides forming recesses for receiving a reflective strip.

21. The roadway marker of claim 20, wherein said top area of said raised rumble portion is scalloped to form a recess.

22. The roadway marker of claim 21, wherein said recess has a radius of curvature between two inches and ten inches.

23. The roadway marker of claims 4, 5, 9, 10, 11, 12, 13, 14, 15, 16, 17, 18, 19, 20, 21, or 22, wherein said grooves have an arcuate cross section.

24. The roadway marker of claim 23, wherein said grooves join one another and define sharp teeth.

25. The roadway marker of claim 24, wherein said sharp teeth project away from the center of said base area.

* * * * *